US007372414B2

(12) United States Patent
Soiron et al.

(10) Patent No.: US 7,372,414 B2
(45) Date of Patent: May 13, 2008

(54) APPARATUS FOR EMISSION AND/OR RECEPTION OF ELECTROMAGNETIC WAVES FOR AERODYNES

(75) Inventors: Michel Soiron, Chavenay (FR); Georges Guillaumot, Tigery (FR); Thierry Dousset, Saint-Gratien (FR)

(73) Assignee: Thales (FR)

( * ) Notice: Subject to any disclaimer, the term of this patent is extended or adjusted under 35 U.S.C. 154(b) by 0 days.

(21) Appl. No.: 11/639,181

(22) Filed: Dec. 15, 2006

(65) Prior Publication Data

US 2007/0216586 A1 Sep. 20, 2007

(30) Foreign Application Priority Data

Dec. 16, 2005 (FR) ..... 05 12846

(51) Int. Cl.
*H01Q 1/28* (2006.01)

(52) U.S. Cl. ..... 343/708; 343/705; 343/745; 343/789

(58) Field of Classification Search ..... 343/705, 343/708, 745, 789, 778, 872
See application file for complete search history.

(56) References Cited

U.S. PATENT DOCUMENTS 4,148,040 A 4/1979 Lunden et al.
4,931,808 A * 6/1990 Lalezari et al. ..... 343/753
H1219 H * 8/1993 Miller ..... 343/708
5,359,338 A * 10/1994 Hatcher et al. ..... 343/778
5,982,339 A * 11/1999 Lalezari et al. ..... 343/872
6,208,304 B1 3/2001 Strickland
6,714,163 B2 * 3/2004 Navarro et al. ..... 343/705

FOREIGN PATENT DOCUMENTS

EP 0 829 918 3/1998
EP 0 829 918 A 3/1998
WO 03/058753 7/2003
WO 03 058753 A 7/2003

* cited by examiner

*Primary Examiner*—Douglas W. Owens
*Assistant Examiner*—Chuc Tran
(74) *Attorney, Agent, or Firm*—Lowe Hauptman Ham & Berner, LLP

(57) ABSTRACT

This invention relates to an apparatus for emission and/or reception of electromagnetic waves for aerodynes, characterised in that it comprises a blade antenna on the top of the fuselage of the aerodyne, a principal reflect-array arranged horizontally at the bottom of the blade antenna, a principal illumination horn arranged at the summit of the blade antenna, the horn illuminating the principal reflect-array, two secondary reflect-arrays arranged vertically on each side of the faces of the blade antenna, two secondary illumination horns arranged at the bottom of the blade antenna in the plane of the principal reflect-array, each horn illuminating one of the secondary reflect-arrays, each reflect-array reflecting waves emitted by the illumination horn illuminating it.

4 Claims, 4 Drawing Sheets

APPARATUS FOR EMISSION AND/OR RECEPTION OF ELECTROMAGNETIC WAVES FOR AERODYNES

This invention relates to an apparatus for emission and/or reception of electromagnetic waves for aerodynes. It is applicable for example in the aeronautics domain.

New entertainment or communication services are now offered to passengers in commercial and business aircrafts, and all these services are currently referred to by the term <<In Flight Entertainment>> (abbreviated IFE services in the following description). IFE services create new constraints. For example, access to high speed Internet for each passenger requires very high transmission rates to geostationary satellites that distribute information. An additional emitting and/or receiving antenna has to be installed on the upper part of aircraft fuselages. Firstly, it must be possible to aim this antenna at any satellite, as a function of the geographic position of the aircraft that is continuously moving. Furthermore, the antenna must emit a high frequency wave adapted to high speed connection, for example in the X, Ku or Ka band, in other words at between 10 and 35 Gigahertz. Knowing that conventional communication and navigation functions alone require a large number of antennas distributed on the top and under the beneath of the aircraft, this creates problems with the available space and choice of installation zones, and problems in checking decoupling between antennas.

One conventional solution is to use a directional antenna mechanically oriented towards the satellite, the overall device being enclosed in a fixed radome. But the continuous increase in speed connections requires a corresponding continuous increase in frequencies, for example up to the Ka band, and the design, manufacturing and maintenance cost of this type of antenna is increasing quickly. The limited reliability of any type of mechanical slaving increases costs, and maintenance operations on the top of the aircraft are difficult. Finally, these antennas are large and introduce a significant protuberance on the surface of the fuselage, significantly increasing the drag and therefore the fuel consumption of the aircraft. Furthermore, the use of several of these antennas on the same carrier will create masking zones.

Another solution can be envisaged that overcomes the disadvantages of poor reliability of mechanical slaving. This is the use of three classical fixed electronic scanning antennas arranged on the fuselage of the aircraft in three well-defined directions. A single antenna of this type has only a very limited angular coverage, covering a cone with an angle of the order of about 60° around the direction normal to the antenna. Furthermore, the signal loses quality when it is emitted at an angle far from the direction normal to the antenna. Therefore, three correctly oriented antennas are necessary to satisfy angular coverage constraints, with one being arranged horizontally above the fuselage and the other two arranged vertically on each side of the fuselage. But these antennas are relatively thick because they integrate a wave emission device behind the antenna itself, which is passed through by waves it refracts. Although they are smaller than a mechanical scanning antenna, these antennas are still large and introduce important protuberances. Finally, such a device with three antennas requires a fairly large installation surface area on the surface of the fuselage, which is difficult to find. Maintenance from inside the aircraft is also difficult due to the need for 3 separate accesses.

This three antenna solution could be improved by the use of electronic scanning antennas of a known type referred to as <<reflect-arrays>>. These antennas have the characteristic that they do not comprise a wave emission device integrated into the radiating array and consequently are very thin. These devices do not refract a wave generated behind the antenna, they reflect a wave generated in front of the antenna by an offset wave emission device. A reflect-array antenna adjusts the angle of reflection of the beam by a relative phase shift of the field radiated by elements arranged in array, using exactly the same principle as a classical electronic scanning antenna to adjust the refraction angle. For example, the radiating elements arranged in array may be wave guides integrating diode phase shifters or Micro-Electro-Mechanical Systems, frequently called MEMS. This technology is well known from other applications. In order to use this solution, it is also necessary to install three masts with an aerodynamic profile fitted with illumination horns at their summit to illuminate the three reflect-arrays. This type of antenna has the same angular coverage limitations as classical electronic scanning antennas, namely about 60 degrees around the direction normal to the antenna, and once again three correctly oriented antennas are necessary to satisfy angular coverage constraints. One of them must be installed horizontally on the top of the fuselage with its illumination mast and the other two vertically on each side, also with their illumination masts. But even if the thickness is very low, the surface area required by such a solution is still too large.

It is found that difficulty of installation, additional consumption, lack of reliability and difficult maintenance are essential disadvantages that make current solutions mediocre from an economic point of view.

The main purpose of the invention is to overcome the disadvantages mentioned above by making good use of an existing structure on the aircraft fuselage, namely the blade type antenna. There is a blade antenna on all aircrafts to provide radio voice communications in the VHF and UHF bands.

To achieve this, the purpose of the invention is an apparatus for emission and/or reception of electromagnetic waves for aerodynes comprising a blade antenna installed on the top of the fuselage of the aerodyne. It also comprises a principal reflect-array installed horizontally at the bottom of the blade antenna and a principal illumination horn located at the top of the blade antenna, the horn illuminating the principal reflect-array. It also comprises two secondary reflect-arrays arranged vertically on each side of the faces of the blade antenna and two secondary illumination horns arranged at the bottom of the antenna in the plane of the principal reflect-array, each horn illuminating one of the secondary reflect-arrays. Each reflect-array reflects waves emitted by the illuminating horn that illuminates it.

Advantageously, one of the directional reflect-arrays may be an array of reflecting and directional radiating elements by relative phase shift of the field radiated by the elements, the array being sufficiently thin to not unduly increase the thickness of the blade antenna.

For example, the reflected waves are in the X, Ku or Ka band.

The main advantages of the invention are that it is integrated on an existing support structure namely the blade antenna, without disturbing its operation. Conventional UHF and VHF radio voice communication functions of the blade antenna remain independent of the new functions on other frequency bands. Decoupling is achieved because these functions are applicable to very different frequency ranges. In particular, one can fail without having any influence on the other. Thus, it is a compact and modular multifunction solution that limits the increasing proliferation of antennas and facilitates maintenance. Not requiring any complex mechanical slaving device and making use of a technology based on electronic scanning; it is not only a more reliable solution but it is also a better solution in terms of precision and speed for pointing the beam.

Other characteristics and advantages of the invention will become clear after reading the following description with reference to the appended drawings in which.

Figure 3A:
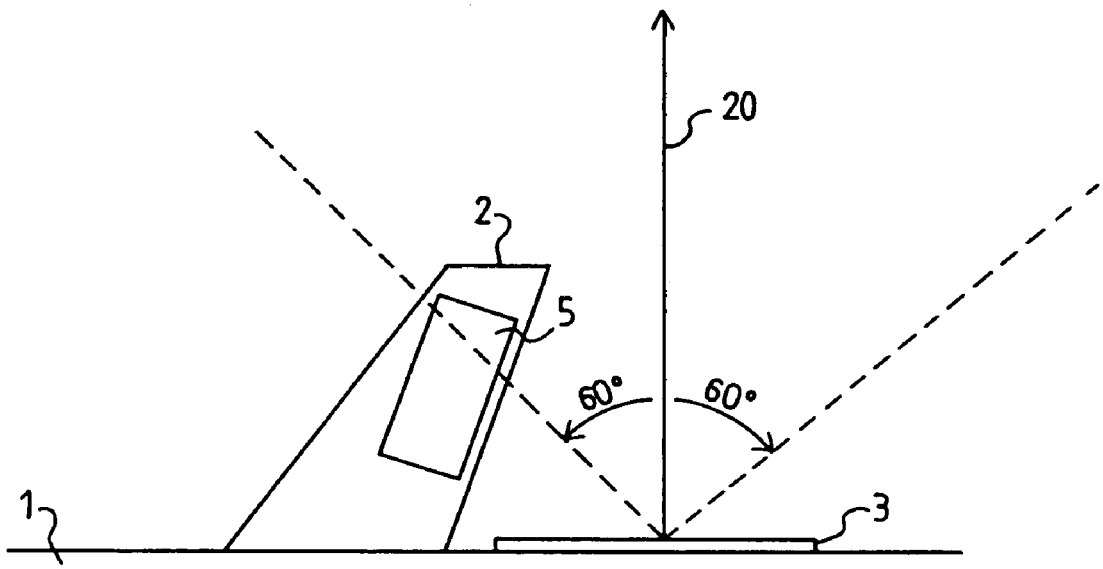
Figure 3B:
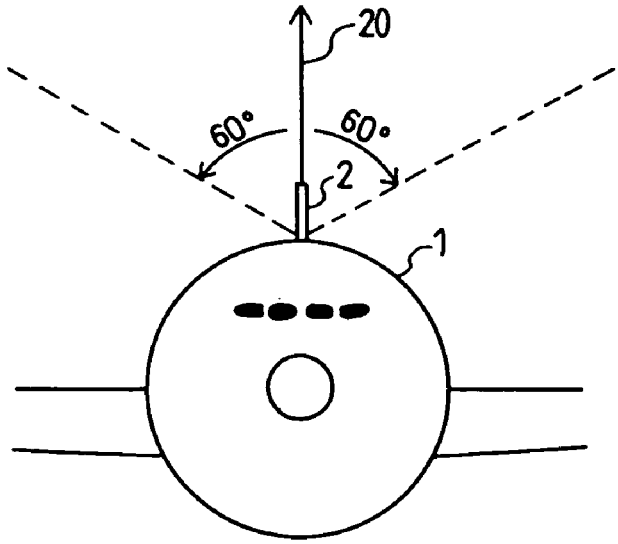
Figure 4A:
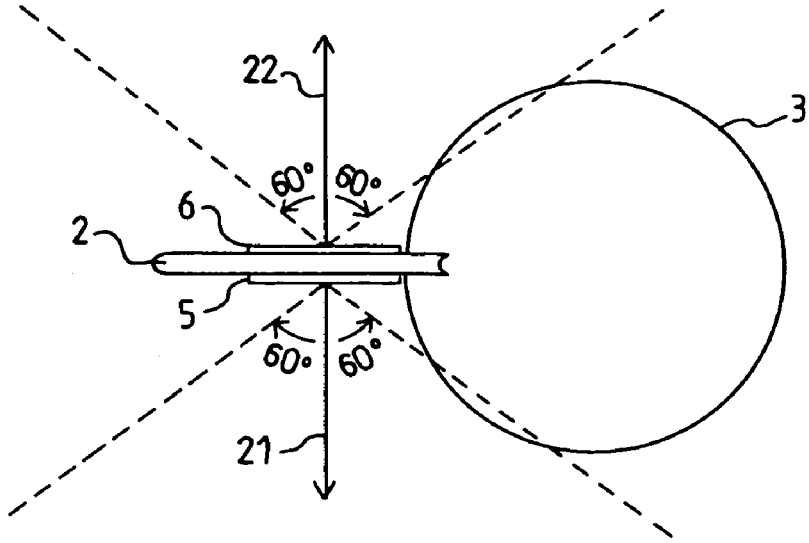
Figure 4B:
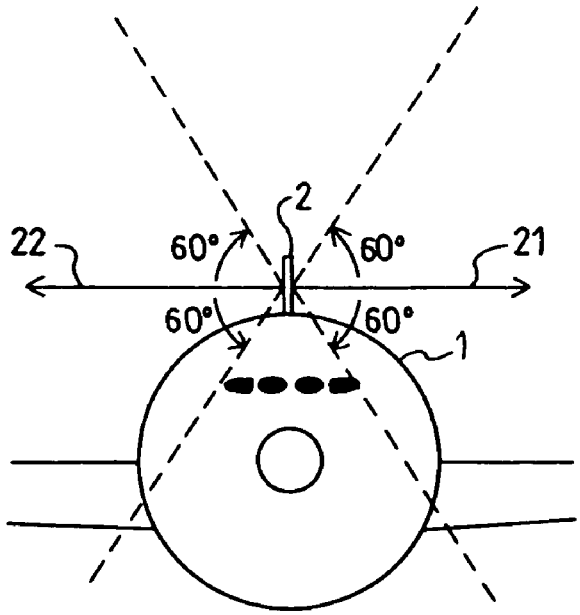

FIGS. 3*a* and 3*b* are illustrations showing side and front views of the angular coverage of the previous example of embodiment of an apparatus according to the invention;

FIGS. 4*a* and 4*b* are illustrations showing top and front views of the angular coverage of the previous example of embodiment of an apparatus according to the invention.

Figure 1:
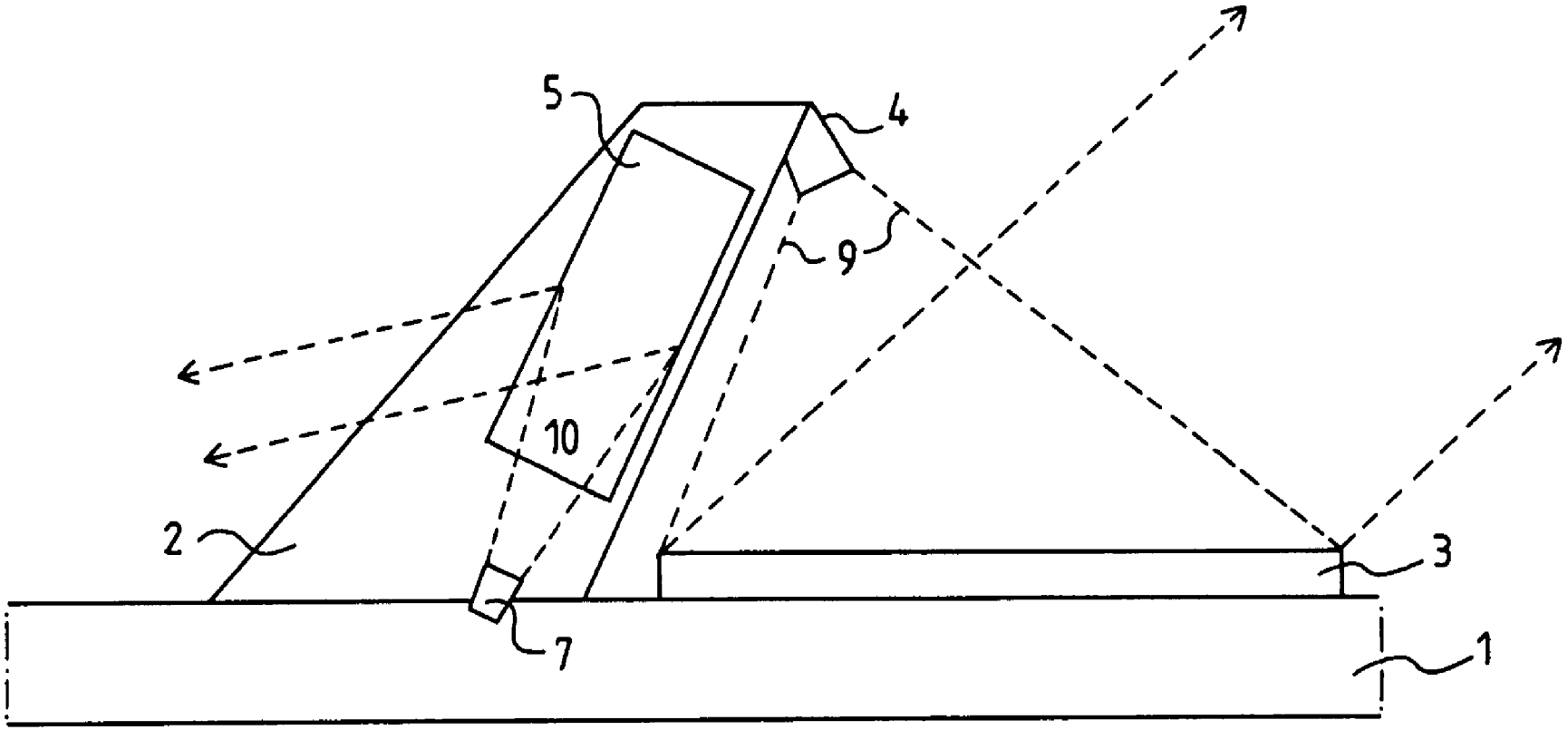
FIG. 1 is an illustration showing a side view of an example of embodiment of an apparatus according to the invention.
Figure 2:
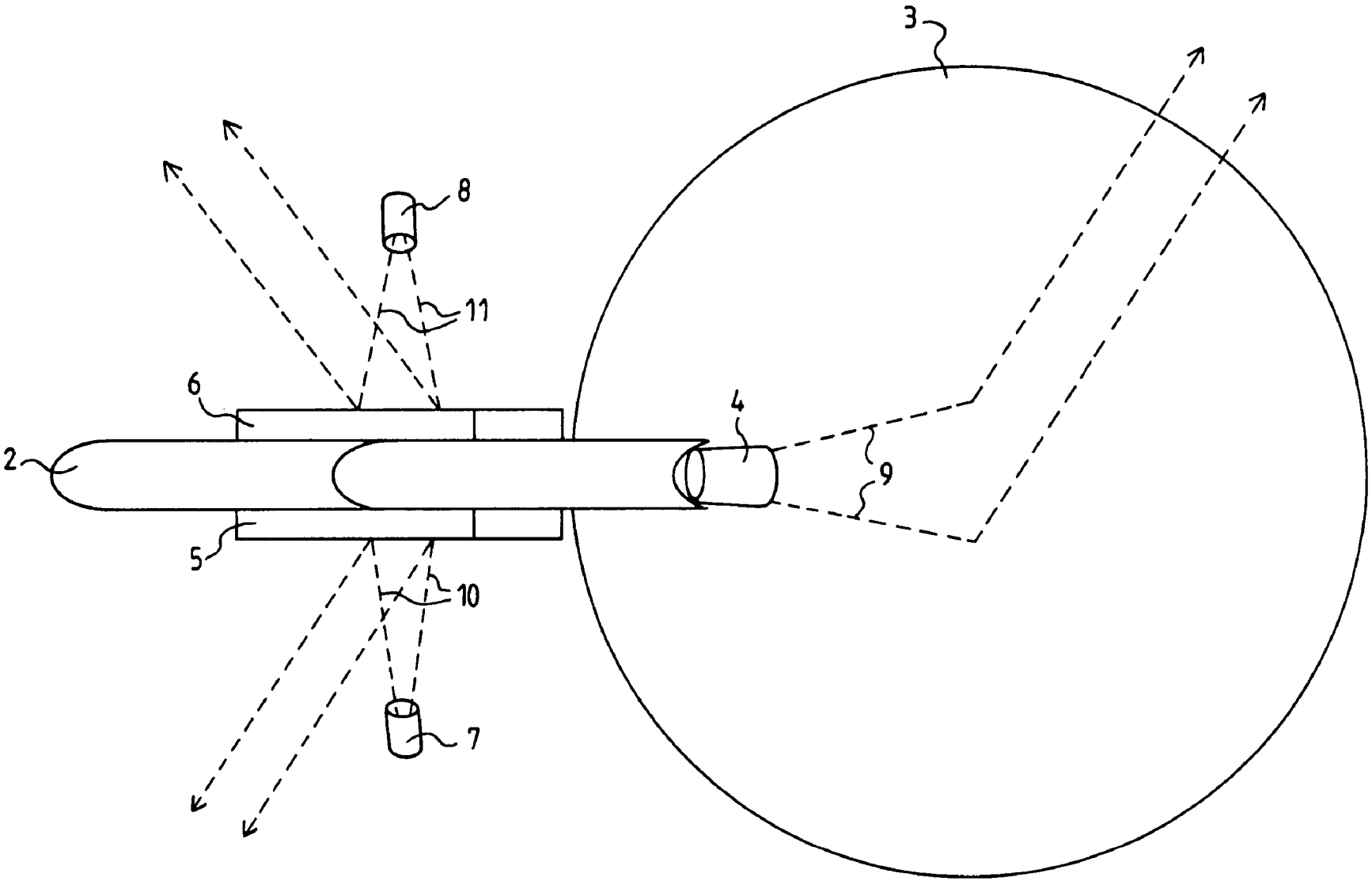
FIG. 2 is an illustration showing a top view of the previous example of embodiment of an apparatus according to the invention.

FIG. 1 and FIG. 2 illustrate the same example of embodiment of an apparatus according to the invention, FIG. 1 showing a side view and FIG. 2 showing a top view. A blade antenna 2 is installed vertically by its base on the top part of the fuselage 1 of an aircraft. A blade antenna is a conducting plate shaped like a blade. For example, it may be a quadrilateral in which two opposite sides forming the base and the top of the antenna are parallel, the length of its base being of the order of twice the length of its top. This blade shape has the twofold advantage of having an aerodynamic profile and being adapted to emission and reception of waves in the VHF and UHF bands used for radio voice communications between the pilot and traffic controllers on the ground. For example, it may be protected by a polyurethane cover.

Advantageously, a reflect-array 3 is installed flat and horizontally on the fuselage of the aircraft at the bottom of the blade antenna 2. An illumination horn 4 is arranged at the top of the blade antenna, for example at the back so as to be over the reflect-array 3 and oriented so as to illuminate it as efficiently as possible. A beam 9 of circular waves output from the illumination horn 4, in other words composed of spherical waves going in all directions, is reflected by the reflect-array 3 in a beam of plane waves, in other words composed of waves going in a single direction. This reflection direction depends on the relative phase shift of the field radiated by the elements of the reflect-array. By controlling the modulation of this phase shift, it is easy to change the direction in which the beam is reflected and thus to aim at a geostationary satellite. However, this reflect-array technology cannot reflect a high quality signal outside a 60-degree cone centred on the normal direction to the reflect-array. Therefore, this antenna alone is not sufficient to cover a sufficiently large portion of space to hope to be able to aim at any geostationary satellite.

This is why two other reflect-arrays 5 and 6 are advantageously arranged flat and vertically on each side of the faces of the conducting plate forming the blade antenna. Two illumination horns 7 and 8 are arranged at the bottom of the blade antenna in the plane of the reflect-array 3 facing the reflect-arrays 5 and 6 and oriented so as to illuminate them as efficiently as possible. According to the same principle as above, circular wave beams 10 and 11 output from the illumination horns 7 and 8 are reflected by the reflect-arrays 5 and 6 as plane wave beams. Although each of the two lateral reflect-array antennas has the same angular coverage limitation as the antenna at the bottom of the blade antenna, the total angular coverage of the assembly composed of the three reflect-array antennas is much wider.

For example, the emitted and reflected wave beams are in the X, Ku or Ka frequency band, in other words between 10 and 35 Gigahertz.

FIGS. 3*a* and 3*b* illustrate the angular coverage of the reflect-array antenna 3 in the previous example of embodiment of an apparatus according to the invention.

FIG. 3*a* shows by a side view the angular coverage of the apparatus in a right cone with a 60-degrees half-opening whose axis is the direction 20 normal to the reflect-array 3. FIG. 3*b* shows by a front view the angular range of the apparatus in this cone. The entire portion of space above the aircraft is covered.

FIGS. 4*a* and 4*b* illustrate the angular coverage of reflect-array antennas 5 and 6 in the previous example of embodiment of an apparatus according to the invention.

FIG. 4*a* is a top view showing firstly the angular range of the apparatus in a right cone with a 60-degree half-opening whose axis is the direction 21 normal to the reflect-array 5, and secondly the angular range of the apparatus in a 60-degrees right cone whose axis is the normal 22 to the reflect-array 6. FIG. 4*b* shows a front view of the angular range of the apparatus in these two cones. The entire portion of space both at the right and at the left of the aircraft is covered.

Thus, the apparatus according to the invention leaves only two shadow zones, one towards the front of the aircraft and the other towards the back. Each of these two shadow zones forms a right cone with a half-opening of about 30 degrees whose axis is longitudinal line to the aircraft. But it is worth noting that classical current solutions based on mechanical slaving or electronic scanning also have shadow zones, often due to adjacent equipment. In the case of the apparatus according to the invention, only satellites very far in front of or very far behind the aircraft will be inaccessible.

It has been observed that the position of satellites aimed at and the trajectories followed by long-haul east-west flights in which IFE services are usually offered to passengers, and particularly transatlantic flights, do not require that a beam should be aimed in these directions. Therefore the apparatus according to the invention is quite suitable for transmission of IFE system information. Furthermore, the apparatus according to the invention has a major economic advantage because it does not introduce maintenance difficulties, reliability problems or additional consumption compared with existing solutions based on mechanical slaving or classical electronic scanning.

The embodiment described in the figures uses directional reflect-arrays by relative phase shift of the field radiated by elements. But the invention may be implemented using any other directional reflecting plane technology.

The invention claimed is:

1. An apparatus for emission and/or reception of electromagnetic waves for aerodynes, wherein:

a blade antenna (2) on top of the fuselage of the aerodyne;

a principal reflect-array (3) installed horizontally at the bottom of the blade antenna;

a principal illumination horn (4) arranged at the summit of the blade antenna, the horn illuminating the principal reflect-array;

two secondary reflect-arrays (5, 6) arranged vertically on each side of the faces of the blade antenna;

two secondary illumination horns (7, 8) arranged at the bottom of the blade antenna in the plane of the principal reflect-array, each horn illuminating one of the secondary reflect-arrays;

each reflect-array reflecting the waves (9, 10, 11) emitted by the illumination horn illuminating it.

2. An apparatus for emission and/or reception of electromagnetic waves for aerodynes according to claim 1, wherein the principal reflect-array (3) or one of the secondary reflect-arrays (5, 6) is a directional reflect-array used to reflect all waves in a same direction.

3. An apparatus for emission and/or reception of electromagnetic waves for aerodynes according to claim 1, wherein the principal reflect-array (3) or one of the secondary reflect-arrays (5, 6) is an array of radiating elements that is directional by relative phase shift of the field radiated by the elements.

4. An apparatus for emission and/or reception of electromagnetic waves for aerodynes according to any of the previous claims, wherein the reflected waves are in the X, Ku or Ka frequency band.

* * * * *